US007753556B1

(12) United States Patent
Zhang et al.

(10) Patent No.: US 7,753,556 B1
(45) Date of Patent: Jul. 13, 2010

(54) COMPACT LED LAMP HAVING HEAT DISSIPATION STRUCTURE

(75) Inventors: Wen-Xiang Zhang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/466,370

(22) Filed: May 14, 2009

(30) Foreign Application Priority Data

Mar. 13, 2009 (CN) ..... 2009 1 0300869

(51) Int. Cl.
*F21V 21/02* (2006.01)

(52) U.S. Cl. ..... 362/249.02; 362/800; 362/373; 362/294; 362/404

(58) Field of Classification Search ..... 362/249.02, 362/800, 373, 294, 404–408, 391
See application file for complete search history.

(56) References Cited

U.S. PATENT DOCUMENTS

| | | | | |
|---|---|---|---|---|
| 6,578,994 | B1 * | 6/2003 | Beyerlein | 362/490 |
| 7,420,811 | B2 * | 9/2008 | Chan | 361/709 |
| 7,488,093 | B1 * | 2/2009 | Huang et al. | 362/294 |
| 7,524,089 | B2 * | 4/2009 | Park | 362/294 |
| 7,611,264 | B1 * | 11/2009 | Chang et al. | 362/249.02 |
| 2008/0158888 | A1 * | 7/2008 | Chen | 362/294 |

* cited by examiner

*Primary Examiner*—Laura Tso
(74) *Attorney, Agent, or Firm*—Frank R. Niranjan

(57) ABSTRACT

An LED lamp includes a body comprising a supporting ring and a holding ring. A heat sink cover is mounted to a top surface of the supporting ring to cover a top end of the body. The heat sink cover comprises a plate and a plurality of fins formed on a top surface thereof. An LED module is received in the body and mounted to a bottom surface of the plate. A transparent envelope is mounted to the holding ring to cover a bottom end of the body. A retaining ring is mounted to a bottom surface of the holding ring to secure the transparent envelope in position. A suspension device is mounted to the heat sink cover. A power module is disposed in the suspension device.

16 Claims, 3 Drawing Sheets

COMPACT LED LAMP HAVING HEAT DISSIPATION STRUCTURE

BACKGROUND

1. Field of the Disclosure

The disclosure relates to a light emitting diode (LED) lamp and, particularly, to a hang LED lamp having a compact design with a heat dissipation structure which can effectively dissipate heat generated by the LED lamp.

2. Description of Related Art

As highly effective light sources, LED lamps are widely used in various fields. An LED lamp includes a number of LEDs, and most of the LEDs are driven at the same time, which results in a quick rise in temperature of the LED lamp. Generally, the LED lamp utilizes a heat sink to dissipate heat generated by the LEDs. A conventional hang LED lamp includes a rectangular heat dissipation plate and a number of LEDs mounted on a side of the heat dissipation plate. In operation, the heat generated by the LEDs can be quickly dissipated by the heat dissipation plate. However, the rectangular heat dissipation plate causes the hang LED lamp to be bulky and makes the hang LED lamp having an unattractive appearance.

What is needed, therefore, is a hang LED lamp which can overcome the described limitations.

DETAILED DESCRIPTION

Figure 1:
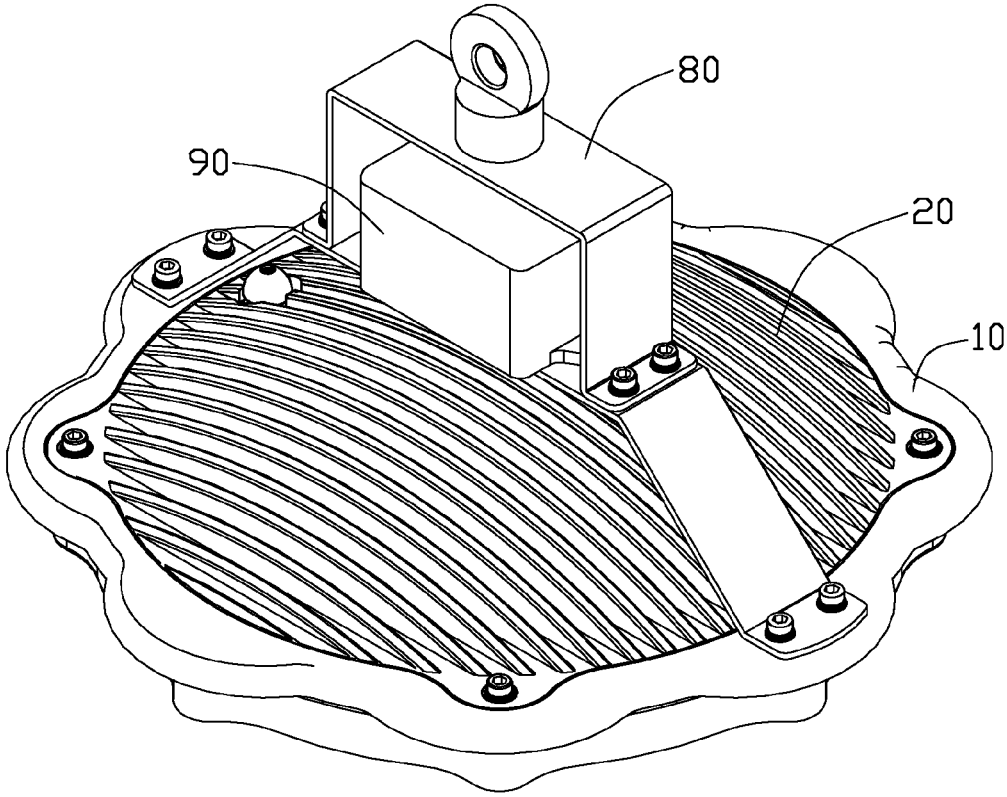
FIG. 1 is an assembled view of a hang LED lamp in accordance with an embodiment of a present disclosure.
Figure 2:
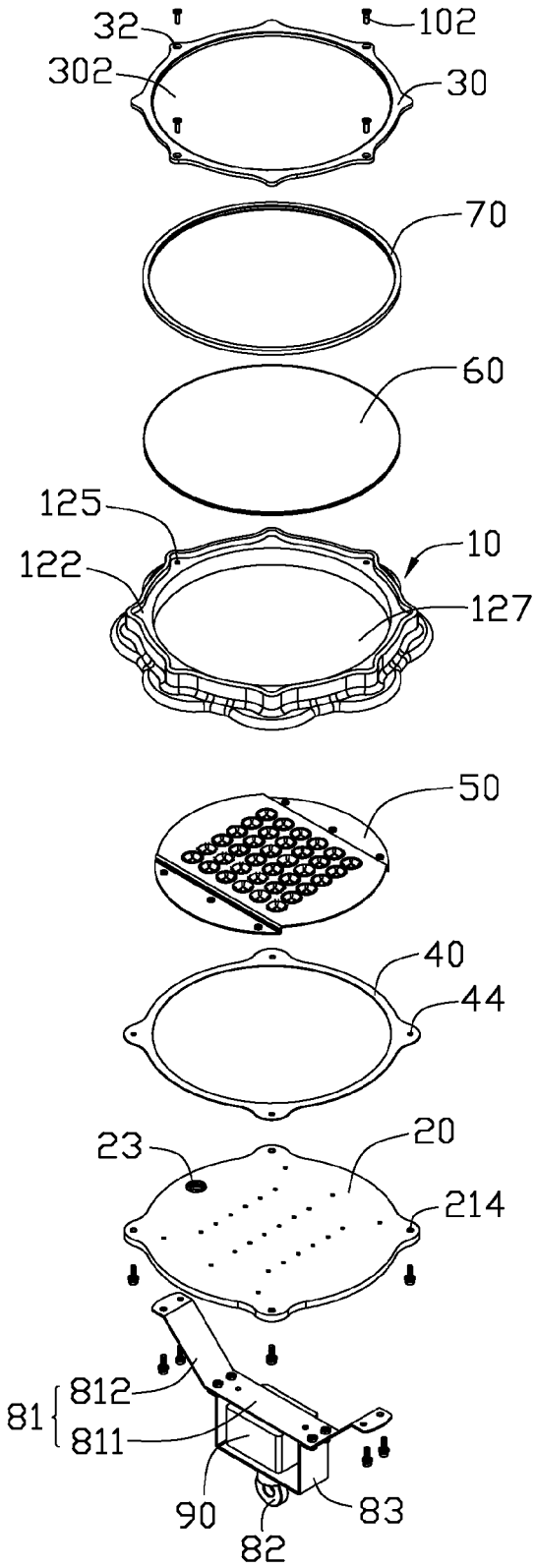
FIG. 2 is an inverted, exploded, isometric view of the hang LED lamp of FIG. 1.
Figure 3:
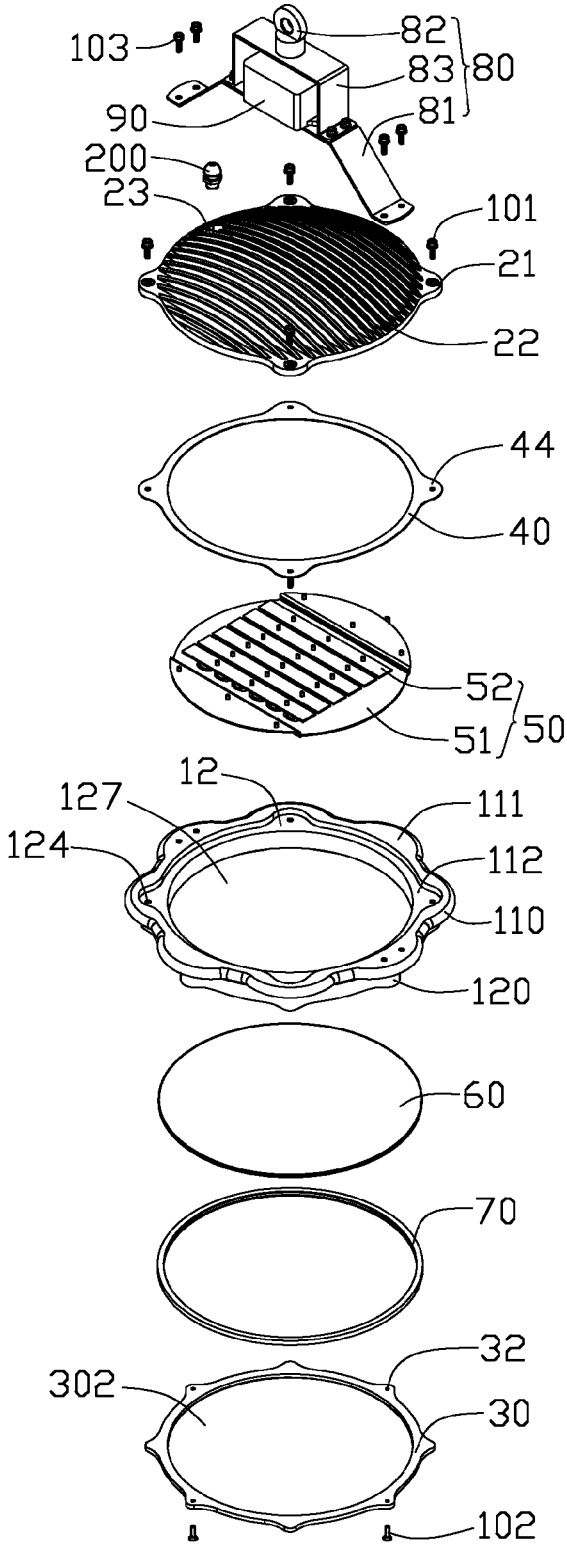
FIG. 3 is an exploded, isometric view of the hang LED lamp of FIG. 1.

Referring to FIG. 1 and FIG. 3, an embodiment of a hang light emitting diode (LED) lamp includes an annular body 10, a heat sink cover 20, a retaining ring 30, a waterproof gasket 40, a light source module 50, a transparent envelope 60, a waterproof ring 70, a suspension device 80 and a power module 90.

The body 10 is integrally made of a metal with a high heat conductivity. The body 10 includes a supporting ring 110 and a holding ring 120 extending downwardly from the supporting ring 110. The supporting ring 110 and the holding ring 120 of the body 10 share a common circular hole 127 extending through the body 10. A thickness of the supporting ring 110 is larger than that of the holding ring 120. A top surface 111 of the supporting ring 110 depresses downwardly to form a recess 12. The supporting ring 110 defines a first mounting surface 112 in the recess 12. The first mounting surface 112 is parallel to the top surface 111. The holding ring 120 has a second mounting surface 122 on a bottom surface thereof. Four first screw holes 124 are equidistantly defined in the first mounting surface 112. Four second screw holes 125 are equidistantly defined in the second mounting surface 122.

The heat sink cover 20 is mounted on the first mounting surface 112 of the body 10. The retaining ring 30 is mounted on the second mounting surface 122 of the body 10. The transparent envelope 60 is received in the holding ring 120 and sandwiched between the second mounting surface 122 and the waterproofing ring 70. The waterproof ring 70 has a step (not labeled) formed by an inner circumference thereof. The step faces upwardly as viewed from FIG. 3 and on which a circumferential edge of the transparent envelope 60 sits. A height of the holding ring 120 below the second mounting surface 122 is equal to or slightly larger than a total height of the retaining ring 30 and the waterproof ring 70. The waterproof gasket 40 is arranged between the heat sink cover 20 and the supporting ring 110 of the body 10 to be compressed between the heat sink cover 20 and the first mounting surface 112 to obtain an excellent sealing effect therebetween. In the illustrated embodiment, the waterproof gasket 40 and the waterproof ring 70 are made of rubber.

The heat sink cover 20 is integrally made of thermally conductive metal. The heat sink cover 20 includes a plate 21 having generally a round shape, and a plurality of fins 22 protruding from a top surface of the plate 21. The fins 22 are parallel to each other. Each of the fins 22 has an arc top surface. Heights the fins 22 gradually decrease from a central portion to an edge portion thereof. That is, a top surface of the heat sink cover 20 cooperatively formed by top ends of the fins 22 is configured to have an arced configuration. An edge of the plate 21 is received in the recess 12. The edge of the plate 21 has four ears (not labeled) equidistantly protruding therefrom. The four ears define four first through holes 214 respectively corresponding to the four first screw holes 124 defined in the first mounting surface 112 of the body 10. The waterproof gasket 40 defines four third through holes 44 corresponding to the four first through holes 214. Four first screws 101 are used to mount the heat sink cover 20 and waterproof gasket 40 to the first mounting surface 112 of the body 10 by sequentially extending the four first screws 101 through the four first through holes 214 and the four third through holes 44 and then screwing the four first screws 101 in the four first screw holes 124.

The heat sink cover 20 defines a void 23 for receiving a waterproof connector 200 therein. The waterproof connector 200 can prevent water or dirt from entering the body 10 to short-circuit or contaminate the light source module 50. The waterproof connector 200 has a bead-like shape and is made of rubber. A passage is defined in the waterproof connector 200 along an axial direction thereof for extension of wires (not shown) therethrough to electrically connect the light source module 50 with the power module 90.

The retaining ring 30 has a form of an annular metallic sheet. A diameter of a bore 302 of the retaining ring 30 is equal to that of the circular hole 127 of the holding ring 120 of the body 10. The retaining ring 30 has an outer circumference with a configuration identical to that of an inner circumference of the holding ring 120, whereby the retaining ring 30 is fittingly received within the holding ring 122, with the bore 302 communicating with the circular hole 127. The retaining ring 30 defines four second through holes 32 corresponding to the four second screw holes 125 in the second mounting surface 122 of the holding ring 120. The retaining ring 30 is mounted to the second mounting surface 122 by extending four second screws 102 through the four second through holes 32 of the retaining ring 30 and screwing the four second screws 102 in the four second screw holes 125 in the second mounting surface 122 of the holding ring 120. When the retaining ring 30 is secured to the second mounting surface 122, the waterproofing ring 70 is compressed between the retaining ring 30 and the second mounting surface 122, and the transparent envelope 60 is compressed between the waterproofing ring 70 and the second mounting surface 122.

The light source module 50 includes a reflector 51 and a LED module 52. The LED module 52 is disposed between the plate 21 of the heat sink cover 20 and the reflector 51. The LED module 52 is securely attached to a bottom face of the plate 21 of the heat sink cover 20, whereby heat generated by the LED module 52 is absorbed by the heat sink cover 20 and dissipated to ambient air through the fins 22. The reflector 51 is securely attached to the bottom face of the plate 21 of the heat sink cover 20 and has a middle portion disposed below the LED module 52 to direct light generated by the LED module 52 to have the required illumination characteristics.

The suspension device 80 is mounted on top surface 111 of the body 10. The suspension device 80 includes a retaining member 81, a suspension member 82 and a receiving member 83 receiving the power module 90 therein. The receiving member 83 is mounted between the retaining member 81 and the suspension member 82. The retaining member 81 is a metallic plate, and includes a straight plate 811 and two lateral plates 812 slantwise extending from two opposite ends of the straight plate 811. The lateral plates 812 are mounted to the plate 21 of the heat sink cover 20. In the present embodiment, each lateral plate 812 defines two screw holes. Four third screws 103 are used to mount the two lateral plates 812 to the plate 21. The receiving member 83 is a metal frame and is mounted to a top surface of the straight plate 811. The suspension member 82 has a ring-shaped configuration, and is mounted to a top surface of the receiving member 82. The suspension member 82 is used to engage with a hook at a bottom end of a rod (not shown) which has a top end secured to a ceiling, for example, to enable the hang LED lamp to perform its intended function.

When the heat sink cover 20 and the waterproof gasket 40 are mounted to the first mounting surface 112 of the body 10, the light source module 50 is placed in the circular hole 127 of the annular body 10 and located above the transparent envelope 60, whereby light generated by the LED module 52 can radiate downwards through the transparent envelope 60 to lighten a space below the hang LED lamp.

Regarding the illustrated embodiment, the LED lamp has a compact structure with a cavity formed among the annular body 10, the heat sink cover 20 and the transparent envelope 60, in which the light source module 50 is received. The power module 90 is placed in the suspension device 80 and outside of the cavity, so that a size, particularly, a height and a weight of the body 10 can be reduced, thereby facilitating a miniaturization the hang LED lamp It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. A hang LED lamp comprising:

a body comprising a supporting ring and a holding ring, the supporting ring and the holding ring sharing a circular hole of the body which extends through the body;

a heat sink cover mounted to a top surface of the supporting ring to cover the circular hole of the body from a top end thereof, the heat sink cover comprising a plate and a plurality of fins formed on a top surface of the plate;

an LED module received in the circular hole and mounted to a bottom surface of the plate so that heat generated by the LED module can be absorbed by the plate of the heat sink;

a transparent envelope mounted to a bottom of the holding ring to cover the circular hole of the body from a bottom end thereof;

a retaining ring mounted to the bottom of the holding ring to secure the transparent envelope to the bottom of the holding ring;

a suspension device mounted on the heat sink cover; and a power module for supplying power to the LED module being disposed in the suspension device.

2. The hang LED lamp of claim 1, wherein a top surface of the supporting ring depresses downwardly to form a recess receiving an edge of the plate of the heat sink cover.

3. The hang LED lamp of claim 1, wherein heights the fins gradually decrease from a central portion to an edge portion of the heat sink cover.

4. The hang LED lamp of claim 3, wherein a top surface of the heat sink cover cooperatively formed by top ends of the fins is configured to have an arced profile.

5. The hang LED lamp of claim 1, wherein the heat sink cover defines a void communicating with the LED module, and a waterproof connector is received in the void.

6. The hang LED lamp of claim 1, wherein a waterproof ring is set around a rim of the transparent envelope, and the waterproof ring is compressed between the bottom of the holding ring and the retaining ring, and the rim of the transparent envelope is compressed between the bottom of the holding ring and the waterproof ring.

7. The hang LED lamp of claim 1, wherein the suspension device comprises a retaining member, a suspension member and a receiving member for receiving the power module, the retaining member is mounted on the plate of the heat sink cover, and the receiving member is mounted between the retaining member and the suspension member.

8. The hang LED lamp of claim 7, wherein the retaining member comprises a straight plate and two lateral plates slantwise extending down from two opposite ends of the straight plate, and the lateral plates are mounted on the plate of the heat sink cover.

9. The hang LED lamp of claim 8, wherein the receiving member is a metal frame, and is mounted on a top surface of the straight plate.

10. The hang LED lamp of claim 9, wherein the suspension member has a ring-shaped configuration, and the suspension member is mounted on a top portion of the receiving member.

11. A hang LED lamp comprising:

a body comprising a holding ring and a supporting flange horizontally extending from circumferential edge of the holding ring;

a heat dissipation plate disposed on a top surface of the supporting flange to cover a circular hole of the hold ring from a top end thereof, an LED module received in the holding ring and mounted to a bottom surface of the heat dissipation plate;

a transparent envelope mounted to a bottom surface of the holding ring to cover the circular hole of the holding ring from a bottom end thereof;

a retaining ring mounted to the bottom surface of the holding ring to secure the transparent envelope in position;

a suspension device mounted on a top surface of the heat dissipation plate; and a power module disposed in the suspension device.

12. The hang LED lamp of claim 11, wherein a plurality of fins formed on the top surface of the heat dissipation plate.

13. The hang LED lamp of claim 12, wherein each of the fins has an arc top surface, and heights of the fins gradually decrease from a central portion to an edge portion of the heat dissipation plate.

14. The hang LED lamp of claim 13, wherein a top surface of the heat dissipation plate cooperatively formed by the top surfaces of the fins is configured to have an arced profile.

15. The hang LED lamp of claim 12, wherein the suspension device comprises a retaining member, a suspension member and a receiving member for receiving the power module, the retaining member is mounted on the heat dissipation plate, and the receiving member is mounted between the retaining member and the suspension member.

16. The hang LED lamp of claim 15, wherein the retaining member comprises a straight plate and two lateral plates slantwise extending down from two opposite ends of the straight plate, and the lateral plates are mounted on the top surface of the heat dissipation plate.

* * * * *